US005416452A

United States Patent [19]

Noerpel et al.

[11] Patent Number: 5,416,452

[45] Date of Patent: May 16, 1995

[54] MODE DIVERSITY COUPLER FOR VERTICAL POLARIZATION

[75] Inventors: Anthony R. Noerpel, Long Branch, N.J.; Adedokun W. Sule-Koiki, Adelphia, Md.

[73] Assignee: Bell Communications Research, Inc., Livingston, N.J.

[21] Appl. No.: 28,750

[22] Filed: Mar. 9, 1993

[51] Int. Cl.[6] ..... H01P 1/16; H01P 5/18

[52] U.S. Cl. ..... 333/113; 333/21 R

[58] Field of Search ..... 333/113, 114, 21 R

[56] References Cited

U.S. PATENT DOCUMENTS

| | | | |
|---|---|---|---|
| 2,883,628 | 4/1959 | Heinard | 333/113 |
| 2,948,864 | 8/1960 | Miller | 333/113 |
| 3,351,874 | 11/1967 | Engler et al. | 333/113 |
| 3,518,576 | 6/1970 | Algeo | 333/114 |
| 4,994,819 | 2/1991 | Noerpel | 333/113 X |
| 5,196,812 | 3/1993 | Drost et al. | 333/113 |

OTHER PUBLICATIONS

F. Sporleder, *Erweiterte Theorie der Lochkopplung*, Dr.-Ing.-Thesis, Technische, Universitat Braunschweig, Germany, 1976.

R. Levy, *Improved Single and Multi-Aperture Waveguide Coupling Theory, Including Explanation of Mutual Interactions*, Apr. 1980, IEEE Transactions on MTT, vol. MTT-28, No. 4, pp. 331-338.

H. A. Bethe, *Theory of Diffraction by Small Holes*, Oct. 1944, The Physical Review, vol. 66, Nos. 7 and 8, pp. 163-182.

N. McDonald, *Polynomial Approximations for the Electric Polarizabilities of Some Small Apertures*, Nov. 1985, IEEE Transactions on MTT, vol. 33, No. 11, pp. 1146-1149.

N. McDonald, *Electric and Magnetic Coupling Through Small Aperture in Shield Walls of Any Thickness*, Oct. 1972, IEEE Transactions MTT, vol. 20, pp. 689-695.

*Primary Examiner*—Paul Gensler

*Attorney, Agent, or Firm*—Leonard Charles Suchyta; James W. Falk

[57] ABSTRACT

A mode coupler for vertically polarized modes comprises a first waveguide (32) having a relatively small rectangular cross-section and a second waveguide (22) having a relatively large rectangular cross-section. The first small cross-section waveguide has a wall (300) formed in common with a portion (400) of a wall (200) of the second large cross-section waveguide. The common wall portion contains a series of circular apertures (202) extending in a longitudinal direction of both waveguides. The centers of the apertures are displaced a first distance ($\tau_1$) from a center line of a wall of the first waveguide and a second distance ($\tau_2$) from a center line of the wall of the second waveguide. In this case, a fundamental $TE_{01S}$ mode of the first waveguide is in phase synchronism and couples equally to the two degenerate $TE_{11L}$ and $TM_{11L}$ higher order vertically polarized modes of the second waveguide.

7 Claims, 2 Drawing Sheets

MODE DIVERSITY COUPLER FOR VERTICAL POLARIZATION

RELATED PATENT

U.S. Pat. No. 4,994,819 entitled "Pattern Diversity in a Microwave Digital Radio System Utilizing A single Horn Reflector Antenna" issued Feb. 19, 1991 to Anthony R. Noerpel and assigned to the assignee hereof contains subject matter related to the subject matter of the present application. The contents of the above-identified patent are incorporated hereby in reference.

1. Field of the Invention

The present invention relates to a mode diversity coupler for vertical polarization. This mode diversity coupler permits mode diversity to be employed for the vertical polarization of a microwave digital radio system.

2. Background of the Invention

The reliability of terrestrial digital radio systems has been improved by the use of space-diversity and frequency-diversity techniques. When combined with so-called hitless (bit-by-bit) switching between on:line and standby radio receivers, these techniques reduce outage time caused by multipath fading phenomena.

On radio paths where outages are primarily due to frequency-selective (dispersive) multipath fading, it has been demonstrated that approaches based on pattern diversity provide protection equal to that of space diversity or frequency diversity but at lower cost. One known pattern-diversity approach requires two horizontally separated antennas which either are characterized by different beam patterns or are purposely misaligned in the elevation plane relative to boresight and to each other. While this approach does not need the expensive wall towers required by space-diversity systems, it still does require two separate antennas.

Another known pattern-diversity approach involves a single antenna with two separate main beams generated, for example, by using two purposely misaligned feeds. This approach provides protection against outage at the expense of deteriorated sidelobe performance and poor cross-polarization discrimination relative to that of a standard antenna.

U.S. Pat. No. 4,994,819, identified above, discloses a system wherein higher-order modes excited in an antenna of a digital radio system are allowed to propagate in a main waveguide connected to the antenna. At least one of these higher-order modes is abstracted from the main waveguide and fed to a standby receiver while the fundamental mode is propagated intact to a main or on-line receiver.

The system is based on the recognition that error occurrences in the fundamental and higher-order modes due to frequency-selective fading are substantially uncorrelated. These modes thereby provide pattern diversity. Hence, upon detecting an error in the signal delivered to the main receiver, the system switches to the standby receiver, thereby providing in a single-antenna system a significant improvement in performance against multipath fading.

A transition waveguide section is utilized to allow only four specified modes of those excited in the antenna to propagate in the main waveguide. By means of a coupler connected to the main waveguide, only a horizontally polarized higher-order mode is coupled into an auxiliary waveguide and delivered to the standby receiver. At the same time, the horizontally polarized fundamental mode is propagated intact in the main waveguide end delivered to the main receiver. Alternatively, only a vertically polarized higher-order mode can be abstracted from the main waveguide by a coupler and delivered to the standby receiver In this case the vertically polarized fundamental mode is delivered intact to the main receiver. Alternatively, both of the horizontally polarized and vertically polarized higher-order modes can be coupled into auxiliary waveguides for transmission to respective standby receivers while the horizontally polarized and vertically polarized fundamental modes are delivered intact to respective main receivers. In each case, substantially uncorrelated signals delivered to an associated pair of standby and main receivers provide a low-cost basis for improving the reliability of the system without degrading its performance.

Herein, for purposes of a specific illustrative example, a terrestrial digital system operating at a frequency of 31 gigahertz (GHz) and having a bandwidth of 2. 5 gigahertz (GHz) will be emphasized. Also, although a variety of antenna designs can in practice be employed in such a system, a conventional conical horn reflector antenna will be specified below.

FIG. 1 illustrates a broadband radio receiving system of the type which is the subject of U.S. Pat. No. 4,994,819. Due to frequency-selective or dispersive fading arising from known multipath phenomena during propagation through the atmosphere, radio signals received by a conical horn reflector antenna 10 shown in FIG. 1 will arrive both perpendicular to the aperture of the antenna (so-called boresight arrival) and off-normal with respect to the antenna aperture (so-called off-axis arrival). The directions of these boresight and off axis-signals are represented in FIG. 1 by arrows 12 and 14, respectively.

Signals arriving along the paths 12 and 14 shown in FIG. 1 cause a variety of modes to be excited in the antenna 10. These consist of the horizontally polarized fundamental mode $HE_{11}$, the vertically polarized fundamental mode $HE_{11}$, the vertically polarized higher-order modes $TE_{01}$ and $HE_{21}$, and the horizontally polarized higher-order modes $TE_{01}$ and $HE_{21}$.

A waveguide element 16 connected to the antenna 10 of FIG. 1 is configured to derive specified modes from those excited in the antenna. These specified modes purposely include both fundamental and a higher-order modes whose respective susceptibilities to errors due to dispersive fading are substantially uncorrelated.

Illustratively, the waveguide element 16 of FIG. 1 comprises a circular cross-section-to-square cross-section transition element connected to the antenna 10 by a standard feed flange 18. By way of example, the inside diameter of the circular cross-section of the element 16 at the flange 18 is 9.144 centimeters (cm), and the length of each side of the square cross-section of the element 16 at connecting flange 20 is 1.212 cm. Illustratively, the length d1 of the waveguide element 16 is 14.00 cm.

The function of the waveguide element 16 of FIG. 1 is to permit four specified modes to propagate in a main square cross-section waveguide 22 directly downstream of the connecting flange 20. (The cross-section of the waveguide 22 and of the bottom end of the element 16 are identical). These modes, which are derived from those excited in the antenna 10 consist of the vertically polarized fundamental mode $TE_{01L}$, the vertically polarized higher-order modes $TE_{11L}$ and $TM_{11L}$, the horizontally polarized fundamental mode $TE_{20L}$, and the horizontally polarized higher-order mode $TE_{20L}$. The subscript "L" indicates that the mode propagates in the waveguide 22.

At least one of the higher-order modes propagated in the main waveguide 22 of FIG. 1 is abstracted therefrom and delivered to a standby receiver. The corresponding polarized fundamental mode continues to propagate downstream in the main waveguide 22 and is delivered to a main receiver 44.

By way of a specific example, the particular illustrative system shown in FIG. 1 includes instrumentalities for independently abstracting both polarizations of the higher-order modes from the main waveguide 22. A waveguide element 24 coupled to the main waveguide 22 between the flange 20 and a downstream connecting flange 26 serves to couple the horizontally polarized higher-order mode from the waveguide 22 to the waveguide element 24. In the element 24, this higher-order mode propagates as the $TE_{10S}$ mode. In turn, the horizontally polarized $TE_{10S}$ mode is delivered by the waveguide element 24 to a standby receiver 28.

Thus, the portion of the main waveguide 22 between the connecting flanges 20 and 26 constitutes, in combination with the adjacent portion of the waveguide element 24, a coupler for abstracting the specified horizontally polarized higher-order mode from the main waveguide. Significantly, the horizontally polarized fundamental mode and the vertically polarized fundamental and higher-order modes launched into the main waveguide 22 are substantially unaffected by the action of the coupler and continue to propagate downstream in the main waveguide.

Another portion of the main waveguide 22 constitutes a part of a second coupler depicted in FIG. 1. This second coupler, which includes a waveguide element 32 coupled to the main waveguide 22 between the flange 26 and a downstream connecting flange 30, serves to couple the vertically polarized higher-order modes from the waveguide 22 to the waveguide element 32. In the waveguide 32, these higher-order modes couple into and propagate as the fundamental $TE_{10S}$ mode. The vertically polarized $TE_{10S}$ mode propagates in the waveguide element 32 to a standby receiver 34. Significantly, the vertically and horizontally polarized fundamental modes in the waveguide 22 are substantially unaffected by the action of this second-described coupler and continue to propagate downstream in the main waveguide.

The modes in the waveguide 22 are designated with the subscript "L" because the waveguide 22 has relatively large cross-sectional dimensions and the modes in the waveguides 24 and 32 are designated with the subscript "S" because these waveguides have smaller cross-sectional dimensions.

As indicated in FIG. 1, the main waveguide 22 terminates in a unit 36 that comprises a conventional polarization separator/combiner. During reception of signals, the unit 36 functions as a separator which directs the horizontally polarized fundamental mode in one direction, say to the left, and directs the vertically polarized fundamental mode in the other direction, as indicated by arrows 38 and 40, respectively. In turn, each mode propagates via a standard circulator to a main receiver. Thus, the horizontally polarized fundamental mode propagates via the circulator 42 to a main or on-line receiver 44. Similarly, the vertically polarized fundamental mode propagates via the circulator 46 to a main or on-line receiver 48.

Emphasis above has been directed to the receiving function performed by the antenna 10 and the aforespecified associated equipment. But such a system is of course ordinarily designed to serve also as a radio transmitter. To illustrate this capability of the depicted system, transmitters 50 and 52 are shown in FIG. 1 connected to the circulators 42 and 46, respectively.

Horizontally polarized fundamental-mode signals provided by the transmitter 50 of FIG. 1 are applied to the unit 36 via the circulator 42, and vertically polarized fundamental-mode signals provided by the transmitter 52 are applied to the unit 36 via the circulator 46. In turn, the unit 36 combines these fundamental modes and applies them to the main waveguide 22 for propagation to the antenna 10. In turn, these modes are then transmitted via the atmosphere to one or more remote antennas (not shown).

The particular illustrative system shown in FIG. 1 is capable of simultaneously receiving separate and distinct vertically polarized and horizontally polarized radio channels each carrying independent digital information. The horizontally polarized channel involves the main receiver 44 and the associated standby receiver 28, whereas the vertically polarized channel involves the main receiver 48 and the associated standby receiver 34. In each case, the identical information received by the associated pair of receivers is substantially uncorrelated insofar as susceptibility to dispersive-fading errors goes. Thus, a high likelihood exists that if an error occurs in the information delivered to the main receiver, the corresponding information delivered to the associated standby receiver will be error-free.

By conventional error control techniques, it is a straightforward matter to detect the occurrence of errors on a bit-by-bit basis in the digital signal train received by the FIG. 1 system. Thus, for example, conventional error-detecting and switching circuitry 54 determines whether the output of the main receiver 44 or that of the standby receiver 28 is to be applied to utilization equipment 55. Whenever an error is detected to occur in a bit received by the main receiver 44, the circuitry 54 blocks that bit from being applied to the equipment 55 and instead applies thereto the corresponding bit from the standby receiver 28. In a similar fashion, error-detecting and switching circuitry 56 determines on a bit-by-bit basis whether the output of the main receiver 48 or that of the standby receiver 34 is to be applied to utilization equipment 57.

It is known that multi-apertured directional couplers are effective to transfer energy from one waveguide into another. In particular, such a device can be utilized to transfer higher-order-mode energy from a main antenna feed waveguide into a separate waveguide coupled thereto. A specific illustrative coupling structure designed to abstract the horizontally polarized higher-order mode from the main waveguide 22 of FIG. 1 at a frequency of 31 GHz is disclosed in U.S. Pat. No. 4,499,819.

It is an object of the present invention to provide a coupler for transferring higher-order-mode energy in a higher order vertically polarized mode propagating in a main antenna feed waveguide (e.g., waveguide 22 of FIG. 1) into a separate waveguide (e.g., waveguide 32) coupled thereto.

SUMMARY OF THE INVENTION

The present invention is directed to a mode diversity coupler for vertical polarization. The coupler of the present invention transfers higher-order-mode energy in a higher order vertically polarized mode propagating in a main antenna feed waveguide into a separate fundamental mode waveguide coupled thereto.

More particularly, the inventive coupler couples the energy in the vertically polarized $TE_{11L}$ and $TM_{11L}$ degenerate mode pair out of the feed waveguide of a horn antenna into the fundamental mode $TE_{01S}$ of a fundamental waveguide arranged parallel to the feed waveguide. The feed waveguide and the fundamental waveguide both have rectangular cross-sections with the cross-section of the feed waveguide being larger. The smaller cross-section fundamental mode waveguide has one wall which is formed in common with a portion of one wall of the larger cross-section feed waveguide. A series of apertures are arranged in the common wall portion along a line parallel to the longitudinal axes of both waveguides. In order to transfer the energy from the $TE_{11L}$ and $TM_{11L}$ modes of the feed waveguide into the $TE_{01S}$ of the fundamental mode waveguide, the three coupled modes are required to propagate in phase synchronism. This is achieved by properly selecting the dimensions of the fundamental mode waveguide and properly selecting the locations and dimensions of the apertures located in the common wall portion between the two waveguides. In particular, the apertures are offset from a center line in said one wall of the fundamental mode waveguide by a distance $\tau_1$ and the apertures are offset from a center line in said one wall of the feed waveguide by a distance $\tau_2$.

DETAILED DESCRIPTION OF THE INVENTION

INTRODUCTION

Figure 1:
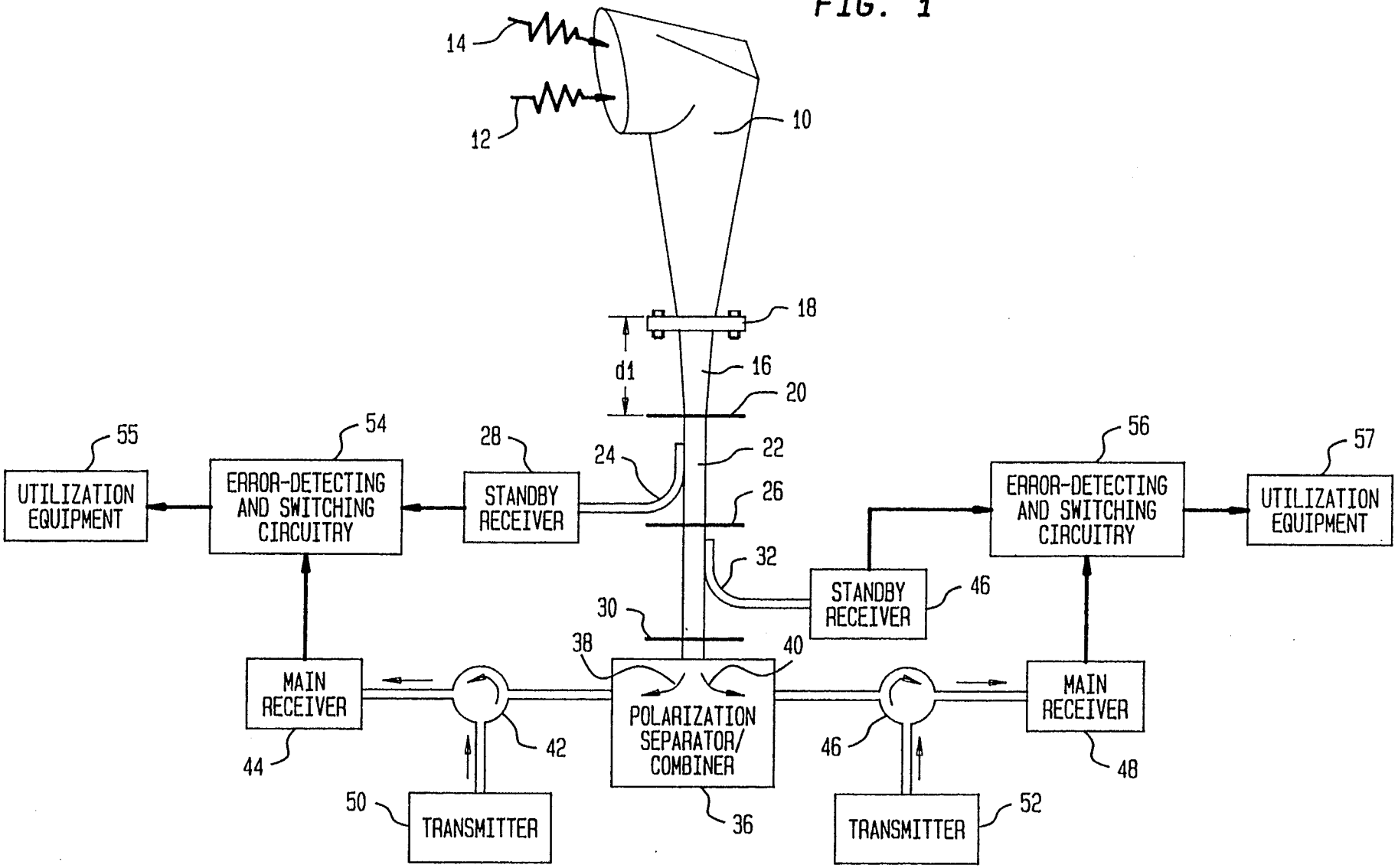
FIG. 1 schematically illustrates a prior art broadband radio receiving system which uses mode diversity.
Figure 2:
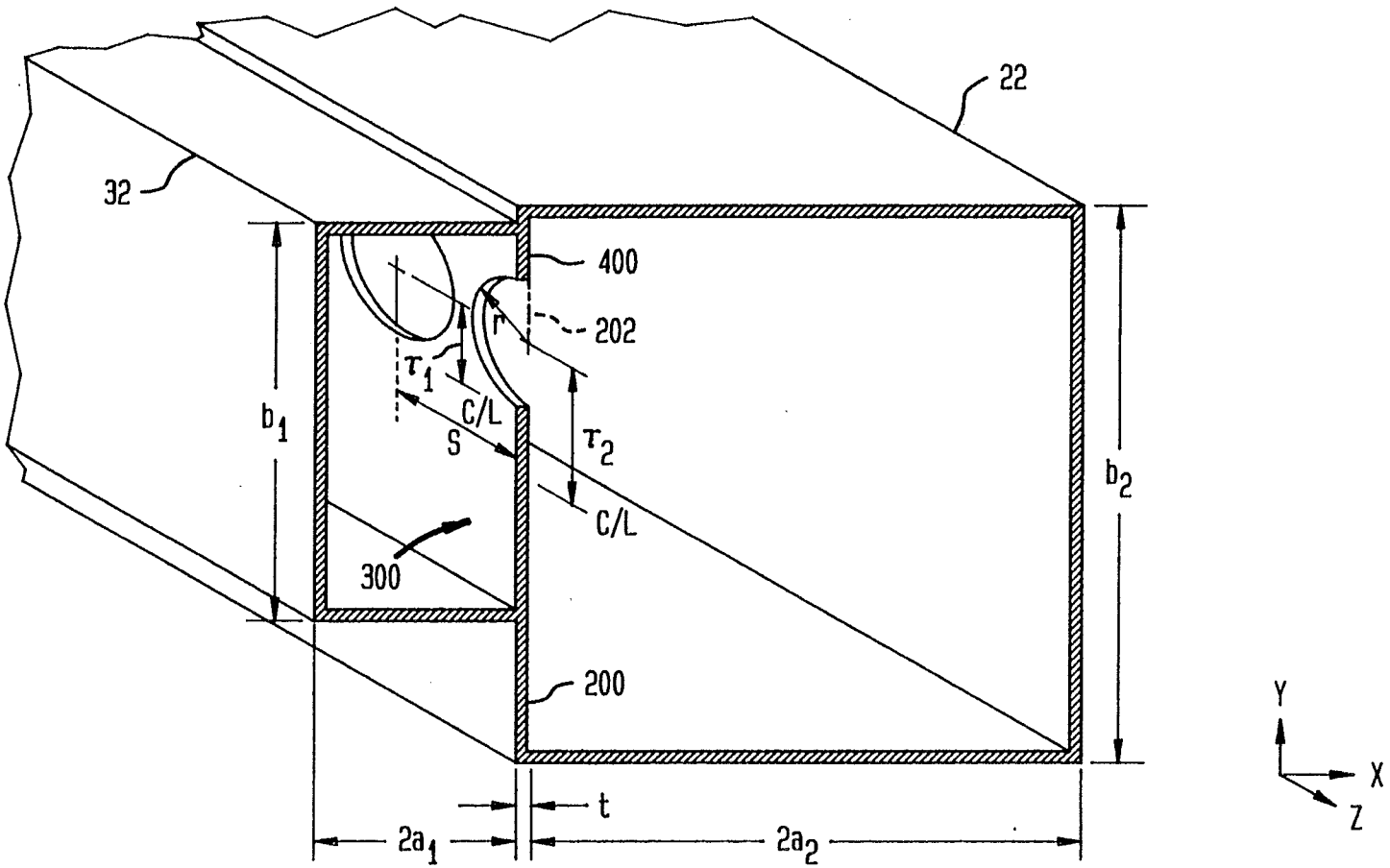
FIG. 2 illustrates a mode diversity coupler for use in the system of FIG. 1 in accordance with the present invention.

FIG. 2 shows the mode diversity coupler for vertical polarization of tile present invention in greater detail. As shown in FIG. 2, the main antenna feed waveguide 22 is rectangular in cross-section and has dimensions $b_2$ and $2a_2$ in the x–y plane. The fundamental mode waveguide 32 is also rectangular in cross-section and has dimensions $b_1$ and $2a_2$ in the x–y plane. The waveguides 22 and 32 both extend longitudinally in the z direction. The waveguide 22 has a side wall 200 at $x=2a_2$ and the waveguide 32 has a side wall 300 at $x=a_1$. The side wall 300 is formed in common with a portion 400 of the wall 200. The waveguide walls have a thickness t.

The waveguide 22 is an overmoded feed waveguide which carries the higher order modes as well as the fundamental mode for both the vertical and horizontal polarizations. The waveguide 32 is a fundamental mode waveguide which propagates only the fundamental $TE_{01S}$ mode. The apertures 202 in the common wall portion 400 are circular apertures of radius r. The aperture centers are separated by a distance s along the z axis. These apertures couple energy from the degenerate vertically polarized higher order $TE_{11L}$ and $TM_{11L}$ modes of the waveguide 22 into the fundamental $TE_{01}$ mode of the waveguide 32.

In order to transfer energy from the degenerate $TE_{11L}$ and $TM_{11L}$ modes of the waveguide 22 into the fundamental mode $TE_{01S}$ of the waveguide 32, the three modes must propagate in phase synchronism. This is achieved by a proper design of the waveguide and aperture dimensions. First, the dimensions of the large waveguide 22, $2a_2$ and $b_2$, are chosen such that the higher order modes $TE_{11L}$ and $TM_{11L}$ are below the cutoff condition. In any rectangular waveguide, unperturbed by apertures, the two degenerate modes $TE_{11L}$ and $TM_{11L}$ will have the same phase velocity. However, the effect of the apertures 202 is to disturb these velocities so that these nodes are no longer degenerate. By offsetting the center of the apertures 202 in the common wall portion 400 by a distance $\tau_2$ from the center line C/L of the wall 200 in the waveguide 22, the self-coupling and therefore the phase velocities of the $TE_{11L}$ and $TM_{11L}$ modes in the waveguide 22 can be made equal. Next, the dimensions of the fundamental mode waveguide 32 are chosen so that the $TE_{01S}$ mode therein is in phase synchronism with the $TE_{11L}$ and $TM_{11L}$ modes of the waveguide 22 and the coupling of the $TE_{11L}$ mode to the $TE_{01S}$ mode is equal to coupling of the $TM_{11L}$ mode to the $TE_{01S}$ mode. These two conditions are met by suitable choice of the dimensions $2a_1$ and $b_1$ of the waveguide 32 and by offsetting the centers of the apertures 202 a distance $\tau_1$ from a center line C/L in the wall 300 of the waveguide 32.

A method for determining the dimensions of the waveguides and the offset $\tau_1$ and $\tau_2$ is presented below.

A. Modes in the Coupler

The modal eigenfunction, $T_i$, for the $i^{th}$ $TE_{mn}$ or H mode is:

$$T_1^{(H)} = \frac{1}{k_{c1}} \sqrt{\frac{\epsilon_n \epsilon_m}{2ab}} \cos(k_y y) \begin{cases} (-1)^{\frac{(m-1)}{2}} \sin(k_x x) \text{ for } m \text{ odd} \\ (-1)^{\frac{m}{2}} \cos(k_x x) \text{ for } m \text{ even} \end{cases} \quad (1)$$

where $\epsilon_m$ is the Newman's number which is 1 if n=0 and 2 if n≠0 and $k_{ci}$, the transversal wave number, is $$k_{c1} = \left\{ \left( \frac{m\pi}{2a} \right)^2 + \left( \frac{n\pi}{b} \right)^2 \right\}^{\frac{1}{2}} \quad (2)$$

The factors $k_y = n\eta/b$ and $k_x = m\eta/2a$ are the separate constants for the y and x dependence respectively. The characteristic impedance of the H modes in the waveguide is given by:

$$Z_1^{(H)} = \frac{j\omega\mu}{\gamma_1} \quad (3)$$

The model eigenfunction, $T_1$, for the $i^{th}$ $TM_{mn}$ or E mode is:

$$T_1^{(E)} = \frac{1}{k_{c1}} \sqrt{\frac{2}{ab}} \sin(k_y y) \begin{cases} \cos(k_x x) & \text{for } m \text{ odd} \\ \sin(k_x x) & \text{for } m \text{ even} \end{cases} \quad (4)$$

where $k_{cl}$ and kx and $k_y$ are defined as for the $TE_{mn}$ modes.

The characteristic impedance of the E modes in the waveguide is given by:

$$Z_1^{(E)} = \frac{\gamma_1}{j\,\omega\,\epsilon} \tag{5}$$

When a mode does not propagate, its characteristic impedance $Z_i$ is imaginary, indicating that there is no net energy flow associated with the mode. The mode is said to be an evanescent mode.

For both $TE_{mn}$ and $TM_{mn}$ modes, the propagation constant $\gamma_i$ is given above cutoff as $$\gamma_1 = j\beta_1 = j\sqrt{k^2 - k_{c1}^2} \tag{6a}$$

and for modes below cutoff as $$\gamma_1 = \alpha_1 = \sqrt{k_{c1}^2 - k^2} \tag{6b}$$

From the modal eigenfunctions, $T_i$, the field expressions for the modes can be determined. The modes are evaluated at the center of the apertures in both waveguides at $x=-a_2$ and at $y=b_2/2+\tau_2$ in the overmoded waveguide 22 and at $x=+a_1$ and at $y=b_1/2+\tau_1$ in the fundamental mode waveguide 32. The $TE_{11L}$ mode is arbitrarily designated mode 1. The $TM_{11L}$ and $TE_{01S}$ modes are designated modes 2 and 3 respectively. The field expressions for these modes, given below are normalized with respect to impedance.

The normalized field expressions for the $TE_{11}$ mode evaluated at the center of the aperture in the large waveguide 22 are:

$$\bar{H}_z = \frac{k_{c1}}{\sqrt{\gamma_1}}\sqrt{\frac{2}{a_2\,b_2}}\,\sin(k_{y1}\,\tau_2)) \tag{7a}$$

for the longitudinal field and $$\bar{E}_x = -j\,k\,\frac{k_{y1}}{k_{c1}}\sqrt{\frac{2}{\gamma_1\,a_2\,b_2}}\,\cos(k_{y1}\,\tau_2) \tag{7b}$$

and $$\bar{H}_y = -\frac{k_y}{K_{c1}}\sqrt{\frac{2\,\gamma_1}{a_2\,b_2}}\,\cos(k_{y1}\,\tau_2) \tag{7c}$$

for the transverse fields.

The normalized field expressions of the $TM_{11}$ mode are $$\bar{H}_z=0 \tag{8a}$$

for the longitudinal field and $$\bar{H}_y = -j\,k\,\frac{k_{x2}}{k_{c2}}\sqrt{\frac{2}{\gamma_2\,a_2\,b_2}}\,\cos(k_{y2}\,\tau_2) \tag{8b}$$

and

-continued $$\bar{E}_x = -\frac{k_{x2}}{k_{c2}}\sqrt{\frac{2\,\gamma_2}{a_2\,b_2}}\,\cos(k_{y2}\,\tau_2) \tag{8c}$$

for the transverse fields.

Finally, the normalized fields expressions for the $TE_{01S}$ mode evaluated at the center of the apertures in the small waveguide 32 are $$\bar{H}_z = -\frac{k_{c3}}{\sqrt{\gamma_3}}\,\frac{1}{\sqrt{a_1\,b_1}}\,\sin(k_{y3}\,\tau_1) \tag{9a}$$

for the longitudinal field and $$\bar{H}_y = \sqrt{\frac{\gamma_3}{a_1\,b_1}}\,\cos(k_{y3}\tau_1) \tag{9b}$$

and $$\bar{E}_x = +j\,\frac{k}{\sqrt{\gamma_3\,a_1\,b_1}}\,\cos(k_{y3}\tau_1) \tag{9c}$$

for the transverse fields.

All the $\bar{E}_y$, $\bar{E}_x$ and $\bar{H}_x$ field components for the three modes vanish at the x=a walls because of the boundary condition at the surface of the unperturbed waveguide which is a perfect conductor.

B. Coupling Coefficient for the Modes

Bethe's equation for waveguides coupled through a set of circular apertures or holes is applied as follows:

$$\kappa_{mn} = \text{sign}(m)\,\frac{1}{2\,s}\,p_1\bar{E}_{t|n|}\bar{E}_{t|m|} + \text{sign}(m)\,\frac{1}{2\,s}\,p_m\bar{H}_{x|n|}\bar{H}_{x|m|} - \frac{1}{2\,s}\,p_m\text{sign}(n)\bar{H}_{t|n|}\bar{H}_{t|m|} \tag{10}$$

where s is the spacing between the set of apertures and $p_i$ and $p_m$ are the scaler factors of the electric and the magnetic dipole moments, respectively. These dipole sources are taken at the center of the apertures on the waveguides common wall portion 400. Sign(m) is +1 for modes propagating in the +z direction and −1 for modes propagating in the −z direction. At the apertures, the strength of the electric dipole is proportional to the electric field components and the strength of the magnetic dipole is proportional to magnetic field components. These dipoles are directed normal and in the plane of the wall, respectively.

The coefficients of the polarizability of the apertures are:

$$p_{ie} = +\frac{2}{3}\,r^3\,R_I\,K_{ie} \tag{11a}$$

$$p_{me} = +\frac{4}{3}\,r^3\,R_M\,K_{Me} \tag{11b}$$

$$p_{io} = -\frac{2}{3}\,r^3\,R_I\,K_{io} \tag{11c}$$

$$p_{mo} = -\frac{4}{3}\,r^3\,R_M\,K_{Mo} \tag{11d}$$

where $R_M$ and $R_I$ are factors that depend on the thickness of the wall where the holes are situated and, r is the radius of the apertures. The above equations are appropriate for $$kr \leqq 1 \tag{12}$$

when conventional expressions are used for $R_M$, $R_I$, and $K_M$ (see, e.g., Sporleder, F., "Erweiterte Theorie der Lochkopplung," Dr.-Ing.-Thesis, Technische, Universitat Braunschweig, Germany, 1976; R. Levy, "Improved Single and Multi-aperture Waveguide Coupling Theory, Including explanation of Mutual Interactions," IEEE Trans on MTT, Vol. MTT-28, No. 4, April 1980, pp. 331–338; H. A. Bethe, "Theory of Small Holes," The Physical Review, vol. 66, Nos. 6 and 7, October 1944, pp. 163–182; N. McDonald, "Polynomial approximations for the Electric Polarizabilities of Some Small Apertures," IEEE Trans. on MTT, vol. 33, no. 11, November 1985, pp. 1146–1149; N. McDonald, "Electric and Magnetic Coupling Through Small Aperture in Shield Walls of Any Thickness," IEEE Trans. MTT, vol. 20, pp. 689–695, October 1972).

C. The Overmoded Waveguide

The $TE_{11L}$ and $TM_{11L}$ modes are degenerate in the unperturbed large waveguide 22. However, in the presence of perturbations, such as the apertures 202, in general these modes are no longer degenerate due to the self-coupling effect of the perturbation. The coupling of $TE_{11L}$ and $TM_{11L}$ modes in the waveguide 22 requires exact phase synchronism. This is achieved by introducing an aperture offset $\tau_2$. The effective propagation constants $\beta$ of the coupling section are given by $$\hat{\beta}_1=\beta_1+jx_{11}=\beta_2+jx_{22}=\hat{\beta}_2 \tag{13}$$

where $\beta_1$ and $\beta_2$ are the propagation constants in the unperturbed waveguide, as given in Equation (6a), for the $TE_{11L}$, and $TM_{11L}$ modes, respectively, and $k_{11}$ and $k_{22}$ are the self-coupling coefficients for these modes due to the presence of the apertures given in equation (10). Since both modes are in the same waveguide, Equations (11a and 11b) are used to calculate the polarizabilities. And since both the modes are traveling in the +z direction, sign(m) and sign(n) are both equal to +1. Substituting the expressions for $\overline{E}_x$, $\overline{H}_y$ and $\overline{H}_x$ from Equations (7a,b,c) for the $TE_{11L}$ mode into equation (10) there is obtained:

$$\begin{aligned} j\kappa_{11}\, 2s\sqrt{\frac{a_2 b_2}{2}} &= -\frac{k_{y1}^2}{k_{c1}^2} k^2 \frac{j}{\gamma_{11}} \cos^2(k_{y1}\tau_2)\, p_{ie} - \\ &\quad p_{me}\frac{k_{y1}^2}{k_{c1}^2} j\gamma_{11}\cos^2(k_{y1}\tau_2) + \\ &\quad p_{me} k_{c1}^2 \frac{j}{\gamma_{11}} \sin^2(k_{y1}\tau_2) \\ &= \left\{ -p_{ie}\frac{k_{y1}^2}{k_{c1}^2}\frac{k^2}{\beta_{11}} + \right. \\ &\quad \left. p_{me}\beta_1\frac{k_{y1}^2}{k_{c1}^2} \right\}\cos^2(k_{y1}\tau_2) + \\ &\quad p_{me}\frac{k_{c1}^2}{\beta_{11}}\sin^2(k_{y1}\tau_2) \\ &= c_1\cos^2(k_{y1}\tau_2) + c_2\sin^2(k_{y1}\tau_2) \end{aligned} \tag{14}$$

Substituting the expressions for $\overline{E}_x$, $\overline{H}_y$ and $\overline{H}_x$ given in Equations (8a,b,c) into Equation (10) for the $TM_{11L}$ mode, there is obtained $$\begin{aligned} j\kappa_{22}\, 2s\sqrt{\frac{a_2 b_2}{2}} &= p_{ie}\, j\gamma_2\frac{k_{x2}^2}{k_{c2}^2}\cos^2(k_{y2}\tau_2) + \\ &\quad p_{me}k^2\frac{j}{\gamma_2}\frac{k_{x2}^2}{k_{c2}^2}\cos^2(k_{y2}\tau_2) \\ &= -\beta_2 p_{ie}\frac{k_{x2}^2}{k_{c2}^2}\cos^2(k_{y2}\tau_2) + \\ &\quad p_{me}\frac{k^2}{\beta_{22}}\frac{k_{x2}^2}{k_{c2}}\cos^2(k_{y2}\tau_2) \\ &= \frac{k_{x2}^2}{k_{c2}^2}\left\{ p_{me}\frac{k^2}{\beta_2} - \right. \\ &\quad \left. \beta_2 p_{ie} \right\}\cos^2(k_{y2}\tau_2) \\ &= c_3\cos^2(k_{y2}\tau_2) \end{aligned} \tag{15}$$

Since $k_{y2}=k_{y1}$ and $k_{x2}=k_{x1}$, and $k_{c2}=k_{c1}$, and $\beta_2=\beta_1$, there is obtained:

$$c_1 = \frac{k_{y1}^2}{k_{c1}^2}\left\{ p_{me}\beta_1 - \frac{k^2}{\beta_1}p_{ie} \right\} \tag{16}$$

$$c_2 = p_{me}\frac{k_{c1}^2}{\beta_1} \tag{17}$$

$$c_3 = \frac{k_{x2}^2}{k_{c2}^2}\left\{ p_{me}\frac{k^2}{\beta_2} - \beta_2 p_{ie} \right\} \tag{18}$$

Setting $$jx_{11}=jx_{22} \tag{19}$$

requires that $$c_1\cos^2(k_{y1}\tau_2)+c_2\sin^2(k_{y1}\tau_2)=c_3\cos^2(k_{y1}\tau_2) \tag{20}$$

From this equation, there is obtained a closed form expression for the aperture offset, $\tau_2$, as $$\tau_2 = \frac{1}{k_y}\arctan\sqrt{\frac{c_3 - c_1}{c_2}} \tag{21}$$

For complex $R_M$ and $R_I$ the radical in Equation (21) is complex. The square root of a complex number is given by $$\sqrt{x+jy} = \sqrt{re^{j\theta}} = \sqrt{r}\, e^{j\frac{\theta}{2}} \tag{22}$$

The arctangent of a complex number is given by $$\text{Arctan}\, z = n\pi + \frac{1}{2}\arctan\left\{\frac{2x}{1-x^2-y^2}\right\} + \frac{j}{4}\ln\left\{\frac{x^2+(y+1)^2}{x^2+(y-1)^2}\right\} \tag{23}$$

where n is zero, and x is the real part and y is the imaginary part of z.

D. The Fundamental Mode Waveguide

The fundamental mode waveguide 32 is designed to propagate only the $TE_{01S}$ mode. The $TE_{01S}$ mode in the fundamental mode waveguide 32 can only couple to the degenerate modes $TE_{11L}$ and $TM_{11L}$ of the feed waveguide 22, for maximum energy exchange, if all these modes are in phase synchronism. Furthermore, it is required that the $TE_{11L}$ and $TM_{11L}$ mode couple equally to the $TE_{01S}$. These two requirements are $$\beta_3=\beta_3+jk_{33}=\beta_1 \tag{24}$$

and $$k_{13}=k_{23} \tag{25}$$

where $k_{13}$ and $k_{23}$ are the coupling factors of $TE_{11L}$ to $TE_{01S}$ and $TM_{11L}$ to $TE_{01S}$ while $k_{33}$ is the self-coupling of $TE_{01S}$. These coupling factors are calculated using equation (10). This is a system of two equations with three unknowns to determine. There is freedom to choose a value for any one of the unknowns and then solve the two equations to determine the values of the remaining two unknowns. Since these equations are weakly dependent on $a_1$, this variable is fixed and $\tau_1$ and $b_1$ are determined by solving these equations simultaneously.

Consider, first Equation (24). The fields $\overline{E}_x$, $\overline{H}_y$ and $\overline{H}_x$ are given in Equations (9a, b, c) and equation (7a, b, c) for $TE_{01S}$ and $TE_{11L}$, respectively. From equation (10), it can be written $$\begin{aligned} j\kappa_{33} &= -p_{ie}\,k^2\frac{j}{\gamma_3\,2\,s\,a_1\,b_1}\cos^2(k_{y3}\,\tau_1) + \\ &\quad p_{me}\,k_{c3}^2\frac{j}{\gamma_3\,2\,s\,a_1\,b_1}\sin^2(k_{y3}\,\tau_1) - \\ &\quad \frac{j\,\gamma_3}{2\,s\,a_1\,b_1}\cos^2(k_{y3}\,\tau_1) \\ &= -p_{ie}\frac{k^2}{\beta_3 2\,s\,a_1\,b_1}\cos^2(k_{y1}\,\tau_1) + \\ &\quad p_{me}\frac{k_{c3}^2}{\beta_3\,2\,s\,a_1\,b_1}\sin^2(k_{y3}\,\tau_1) + \\ &\quad p_{me}\frac{\beta_3}{2\,s\,a_1\,b_1}\cos^2(k_{y3}\,\tau_1) \\ &= \left\{p_{me}\frac{\beta_3}{\beta_3\,2\,s\,a_1\,b_1} - p_{ie}\frac{k^2}{2\,s\,a_1\,b_1}\right\}\cos^2(k_{y3}\,\tau_1) + \\ &\quad p_{me}\frac{k_{c3}^2}{\beta_3\,2\,s\,a_1\,b_1}\sin^2(k_{y3}\,\tau_1) \end{aligned} \tag{26}$$

Substituting this expression for $K_{33}$, Equation (25) becomes $$\hat{\beta}_1 = \beta_3 + \left\{p_{me}\frac{\beta_3}{2\,s\,a_1\,b_1} - p_{ie}\frac{k^2}{\beta_3 2\,s\,a_1\,b_1}\right\}\cos^2(k_{y3}\,\tau_1) + p_{me}\frac{k_{c3}^2}{\beta_3\,2\,s\,a_1\,b_1}\sin^2(k_{y3}\,\tau_1) \tag{27}$$

Let $$c_4 = \frac{\left\{p_{me}\,\beta_3 - p_{ie}\frac{k^2}{\beta_3}\right\}}{2\,s\,a_1\,b_1} \tag{28a}$$

and $$c_5 = p_{me}\frac{k_{c3}^2}{\beta_3\,2\,s\,a_1\,b_1} \tag{28b}$$

and Equation (27) becomes $$\hat{\beta}_1-\beta_3=c_4\cos^2(k_{y3}\,\tau_1)+c_5\sin^2(k_{y3}\,\tau_1) \tag{29}$$

Dividing both sides of equation (29) by $\cos^2(k_y\tau_1)$, there is obtained:

$$\frac{\hat{\beta}_1 - \beta_3}{\cos^2(k_{y3}\,\tau_1)} = c_4 + c_5\tan^2(k_{y3}\,\tau_1) \tag{30}$$

Using the trigonometry identities $$\frac{1}{\cos^2(k_y\,\tau_1)} = \sec^2(k_y\,\tau_1)$$

and $$1 + \tan^2(k_y\,\tau_1) = \sec^2(k_y\,\tau_1)$$

Equation (30) becomes $$\{\hat{\beta}_1 - \beta_3\}\{1 + \tan^2(k_{y3}\,\tau_1)\} = c_4 + c_5\tan^2(k_{y3}\,\tau_1) \tag{31}$$

This equation can be solved readily for $\tau_1$ $$\tau_1 = \frac{1}{k_{y3}}\arctan\sqrt{\frac{c_4 - \hat{\beta}_1 + \beta_3}{\hat{\beta}_1 - \beta_3 - c_5}} \tag{32}$$

Equation (25) can likewise be solved for $\tau_1$. Using the expressions for the fields of the $TE_{11L}$, $TM_{11L}$ and $TE_{01S}$ modes as given in Equations (7a,b,c), (8a,b,c), and (9a,b,c) respectively, and inserting them into Equation (10), there is obtained the following expressions for the coupling between the $TE_{11L}$ and $TE_{01S}$ modes and the $TM_{11L}$ and $TE_{01S}$ modes:

$$\begin{aligned} 2\,s\,\kappa_{13} &= p_{io}\frac{k_{y1}}{k_{c1}}\,\frac{k^2}{\sqrt{\gamma_1\,\gamma_3}}\,\frac{1}{\sqrt{a_1\,b_1}}\sqrt{\frac{2}{a_2\,b_2}}\cos(k_{y3}\,\tau_1)\cos(k_{y1}\,\tau_2) - \\ &\quad p_{mo}\frac{k_{c1}}{\sqrt{\gamma_1\,\gamma_3}}\,\frac{k_{c3}}{\sqrt{a_1\,b_1}}\sqrt{\frac{2}{a_2\,b_2}}\sin(k_{y3}\,\tau_1)\sin(k_{y1}\,\tau_2) + \\ &\quad p_{mo}\frac{k_{y1}}{k_{c1}}\sqrt{\frac{\gamma_1\,\gamma_3}{a_1\,b_1}}\sqrt{\frac{2}{a_2\,b_2}}\cos(k_{y3}\,\tau_1)\cos(k_{y1}\,\tau_2) \end{aligned} \tag{33}$$

-continued $$2\,s\,\kappa_{23} = -jp_{io}\frac{k_{x2}}{k_{c2}}\frac{k}{\sqrt{a_1 b_1}}\sqrt{\frac{\gamma_2}{\gamma_3}}\sqrt{\frac{2}{a_2 b_2}}\cos(k_{y1}\tau_1)\cos(k_{y2}\tau_2) + jp_{mo}\frac{k_{x2}}{k_{c3}}\frac{k}{\sqrt{a_1 b_1}}\sqrt{\frac{\gamma_3}{\gamma_2}}\sqrt{\frac{2}{a_2 b_2}}\cos(k_{y3}\tau_1)\cos(k_{y2}\tau_2) \quad (34)$$

After equating Equations (33) and (34), the radicals $$\sqrt{\frac{1}{a_1 b_1}} \text{ and } \sqrt{\frac{2}{a_2 b_2}}$$

and aj can be factored out. Recalling that $k_{y2}=k_{y1}$, $k_{x2}=k_{x1}$, $k_{c2}=k_{c1}$, and $\beta_2$ and $\beta_1$, there is obtained $$-p_{io}\frac{k^2}{\sqrt{\beta_1\beta_3}}\frac{k_{y1}}{k_{c1}}\cos(k_{y3}\tau_1)\cos(k_{y1}\tau_2) + p_{mo}\frac{k_{c1}}{\sqrt{\beta_1\beta_3}}k_{c3}\sin(k_{y3}\tau_1)\sin(k_{y1}\tau_2) + p_{mo}\frac{k_{y1}}{k_{c1}}\sqrt{\beta_1\beta_3}\cos(k_{y3}\tau_1)\cos(k_{y1}\tau_2) = -p_{io}\frac{k_{x2}}{k_{c2}}k\sqrt{\frac{\beta_1}{\beta_3}}\cos(k_{y3}\tau_1)\cos(k_{y1}\tau_2) + p_{mo}\frac{k_{x2}}{k_{c2}}k\sqrt{\frac{\beta_3}{\beta_1}}\cos(k_{y3}\tau_1)\cos(k_{y1}\tau_2) \quad (35)$$

Dividing Equation (35) by $\cos(k_{y3}\tau_1)$, there is obtained $$\left\{-p_{io}\frac{k^2}{\sqrt{\beta_1\beta_3}}\frac{k_{y1}}{k_{c1}} + p_{mo}\frac{k_{y1}}{k_{c1}}\sqrt{\beta_1\beta_3}\right\}\cos(k_{y1}\tau_2) + p_{mo}\frac{k_{c1}}{\sqrt{\beta_1\beta_3}}k_{c3}\tan(k_{y3}\tau_1)\sin(k_{y1}\tau_2) = \left\{-p_{io}\frac{k_{x1}}{k_{c1}}k\sqrt{\frac{\beta_1}{\beta_3}} + p_{mo}\frac{k_{x1}}{k_{c1}}k\sqrt{\frac{\beta_3}{\beta_1}}\right\}\cos(k_{y1}\tau_2) \quad (36)$$

Multiplying Equation by 36) by $$\sqrt{(\beta_1 k_{c1}/\beta_3}$$

and rearranging terms, there is obtained $$\left\{p_{io}\frac{k^2}{\beta_3}k_{y1} - p_{mo}k_{y1}\beta_1 - p_{io}k_{x1}k\frac{\beta_1}{\beta_3} + p_{mo}k_{x1}k\right\}\cos(k_{y1}\tau_2) = p_{mo}\frac{k_{c1}^2}{\beta_3}k_{c3}\sin(k_{y1}\tau_2)\tan(k_{y3}\tau_1) \quad (37)$$

Let $$c_6 = \left\{p_{io}\frac{k^2}{\beta_3}k_{y1} - p_{mo}k_{y1}\beta_1 - p_{io}k_{x1}k\frac{\beta_1}{\beta_3} + p_{mo}k_{x1}k\right\}\cos(k_{y1}\tau_2) \quad (38)$$

-continued and $$c_7 = p_{mo}\frac{k_{c1}^2}{\beta_3}k_{c3}\sin(k_{y1}\tau_2) \quad (39)$$

Equation (37) becomes $$c_6 = c_7\tan(k_{y3}\tau_1) \quad (40)$$

Therefore, $$\tau_1 = \frac{1}{k_{y3}}\arctan(c_6/c_7) \quad (41)$$

Equating the two expressions for $\tau_1$, there is obtained an equation with only the variable $b_1$.

$$\frac{1}{k_{y3}}\arctan\sqrt{\frac{c_4 - \hat{\beta}_1 + \beta_3}{\beta_1 - \beta_3 - c_5}} = \frac{1}{k_{y3}}\arctan\left\{\frac{c_6}{c_7}\right\} \quad (42a)$$

$$\sqrt{\frac{c_4 - \hat{\beta}_1 + \beta_3}{\beta_1 - \beta_3 - c_5}} = \left\{\frac{c_6}{c_7}\right\} \quad (42b)$$

$$\frac{c_4 - \hat{\beta}_1 + \beta_3}{\beta_1 - \beta_3 - c_5} = \left\{\frac{c_6}{c_7}\right\}^2 \quad (42c)$$

$$c_7^2\{c_4 - \hat{\beta}_1 + \beta_3\} = c_6^2\{\hat{\beta}_1 - \beta_3 - c_5\} \quad (42d)$$

From Equation (28a), $c_4$ can be rewritten as $$\frac{c_1'}{a_1 b_1}$$

and from Equation (28b), $c_5$ can be rewritten as $$\frac{c_5'}{a_1 b_1}$$

and then substitute them back into equation (42d) and solve for $a_1$.

$$a_1 = \frac{1}{b_1}\frac{c_7^2 c_4' + c_5' c_6^2}{(\beta_1 - \beta_3)(c_7^2 + c_6^2)} \quad (43)$$

where $c_6$, $c_4'$, $c_5'$, $c_7$, and $\beta_3$ are only functions of $b_1$ and $\hat{\beta}_1$ is a constant. To solve for $b_1$, given $a_1$, Equation (42) may be solved using standard numerical techniques.

E. Results

In the last two sections, equations were derived which can be used to design a multi-aperture coupler, employing dissimilar waveguides. Two degenerate modes in an overmoded waveguide 22, the $TE_{11L}$ and the $TM_{11L}$ modes, are coupled to the $TE_{01S}$ mode of another fundamental mode waveguide 32. This coupling is achieved in such a way that the three modes remain in phase synchronism throughout the coupling length. In addition, the coupling to the $TE_{01S}$ mode is nearly equal for both higher order modes. In this section, the design of such a multi-aperture coupler is described.

To start, the x and y dimensions of the large waveguide, in this case the feed waveguide 22, are chosen. One could also start with the smaller waveguide dimensions. These choices are made so that the desired modes can propagate yet other modes are cut off. For a 30 GHz coupler, $a_2=0.184$ inches and $b_2=0.368$ inches where $2a_2$ is the x-dimension and $b_2$ is the y-dimension. The coupler does not have to be square and these dimensions are somewhat arbitrary.

The radius of the coupling ports or apertures is 0.05 inches and the wall thickness t is 0.008 inches. Thicker walls would reduce the evanescent mode coupling between the waveguides and thinner walls would not be strong enough to support the waveguide. The ideal spacing of the apertures is $\lambda/4$ for forward coupling of the energy so that very little energy is coupled in the reverse direction. In this case the contribution from each aperture will add destructively in the reverse direction but constructively in the forward direction. For 30 GHz, a quarter wavelength is 0.1 inches.

In the unperturbed rectangular waveguide, the two coupled modes in the feed waveguide 22, the $TE_{11L}$ and the $TM_{11L}$ modes, are degenerate. For minimum depolarization it is important that these two modes remain in phase synchronism. The effect of the apertures or in general any perturbation of the waveguide is to cause these two modes to propagate with different phase velocities. By offsetting the apertures from the center line of the waveguide by the correct amount this phase synchronism can be maintained even in the presence of the coupling apertures. Equation (21) is a closed form expression for the value of this offset, $\rho_2$ which satisfies the condition of Equation (13) that these two modes propagate with the same velocity. The precise offset is a function of frequency. Solving Equation (21) for 30 GHz results in a value of 0.080 inches for $\tau_2$.

In this case, the smaller waveguide 32 only propagates the $TE_{01S}$ mode. This is the mode that energy is to be coupled into from the feed waveguide 22, and therefore it, also, must be in phase synchronism with the $TE_{11L}$ and the $TM_{11L}$ modes for maximum energy transfer. This condition is given by Equation (24). Another condition that needs to be satisfied is that the coupling of the $TE_{11L}$ mode to the $TE_{01S}$ mode must be equal to the coupling of the $TM_{11L}$ mode to the $TE_{01S}$ mode. This condition is given by Equation (25).

There is now a system of two equations and three unknowns. The unknown dimensions are the x-dimension of the small waveguide, $2a_1$, the y-dimension of this waveguide, $b_1$, and the offset $\tau_1$ of the apertures from the center line, $y=b_1/2$, on the $x=a_1$ wall of the waveguide 32. The two conditions, Equations (24) and (25) are weakly dependent on $a_1$. It is therefore reasonable to chose a value for this dimension which is convenient. The value of $a_1=0.07$ inches is the x-dimension for a standard waveguide in the 26 to 40 GHz waveguide band. Equations (24) and (25) can be solved for $\tau_1$ and equated. The resulting expression, Equation (42) gives a value of $b_1=0.260$ inches. Using either Equation (32) or (41) gives a value of 0.038 inches for $\tau_1$.

There are only three constraints on the design of this multi-aperture coupler which are expressed by Equations (13), (24) and (25). However, there are nine dimensional unknowns that are to be determined. These are the x and y dimensions of the small waveguide 32, $2a_1$ and $b_1$; the x and y dimensions of the large waveguide 22, $2a_2$ and $b_2$; the offset of the apertures in the small and large waveguides $\tau_1$ and $\tau_2$ respectively; the thickness of the wall separating the two waveguides, t; the radius of the apertures r and the separation of the apertures, s. However, the x-dimensions, $a_1$ and $a_2$ have negligible effect on these constraints and should therefore be chosen for convenience of matching the connecting waveguides. The separation of the apertures, should be as close to $\lambda/4$ as possible for the best directivity. The thickness of the wall, t, must be as small as possible while still being strong enough to support the waveguide. These last two consideration constrain the radius r. Therefore, one is left with three equations and four unknowns, namely, $b_1$, $b_2$, $\tau_1$ and $\tau_2$. For the design example given above, $b_2$ was chosen arbitrarily and the other unknowns were then determined by satisfying Equations (13), (24) and (25). It would also be possible to choose $b_1$ and determine the others.

CONCLUSION

A mode diversity coupler for vertical polarization has been disclosed. Finally, the above-described embodiments of the invention are intended to be illustrative only. Numerous alternative embodiments may be devised by those skilled in the art without departing from the scope of the following claims.

We claim:

1. A mode diversity coupler comprising a first waveguide for propagating a fundamental mode, a second waveguide arranged parallel to said first waveguide for propagating one or more higher order vertically polarized modes, a first wall of said first waveguide being formed in common with a portion of a first wall of said second waveguide, said second waveguide having a relatively large rectangular cross-section and said first waveguide having a relatively small rectangular cross-section, and coupling means for coupling the energy in said vertically polarized higher order modes of said second waveguide into the energy of the fundamental mode of said first waveguide, said coupling means comprising a series of circular apertures extending longitudinally along said waveguides and located in said common portion of said first wall of said first waveguide and said first wall of said second waveguide, and wherein the centers of the circular apertures are offset by a first distance from a center line of said first wall of said first waveguide and offset by a second distance from a center line of said first wall of said second waveguide.

2. The mode diversity coupler of claim 1 wherein the higher order vertically polarized modes propagating in said second waveguide are the $TE_{11L}$ and $TM_{11L}$ modes and the fundamental mode propagation in said second waveguide is the $TE_{01S}$ mode,

3. The mode diversity coupler of claim 2 wherein the second distance by which the centers of the apertures are offset from the center line of the first wall of the second waveguide is chosen so that the phase velocities of the $TE_{11}$ and $TM_{11}$ modes are equal.

4. The mode diversity coupler of claim 3 wherein the dimensions of the rectangular cross-section of the first waveguide and the first distance by which the centers of the apertures are offset from the center line of the first wall of the first waveguide are chosen so that the $TE_{01S}$ mode of the first waveguide is in phase synchronism with the $TE_{11L}$ and $TM_{11L}$ modes of the second waveguide and so that the $TE_{01S}$ mode couples equally to the $TE_{11L}$ and $TM_{11L}$ modes.

5. A mode diversity coupler comprising a first waveguide for propagating a fundamental mode, a second waveguide arranged parallel to said first waveguide for propagating one or more higher order vertically polarized modes, and coupling means for coupling the energy in said vertically polarized higher order modes of said second waveguide into the energy of the fundamental mode of the first waveguide, said coupling means maintaining said higher order vertically polarized modes of said second waveguide in phase synchronism with said fundamental mode of said first waveguide and coupling said fundamental mode of said first waveguide equally to each higher order vertically polarized mode of said second waveguide, said second waveguide having a wall, a portion of which is common with a wall of said first waveguide and said coupling means comprising a series of circular apertures arranged longitudinally in the common wall portion of said first and second waveguides, said apertures being displaced a first distance from a center line in said wall of said first waveguide and displaced a second distance from a center line in said wall of said second waveguide.

6. A mode diversity coupler for vertically polarized modes comprising a first waveguide having a relatively small rectangular cross section and a second waveguide having a relatively large rectangular cross-section, said waveguides being parallel and said first waveguide having a wall formed in common with a portion of a wall of said second waveguide, said common wall portion containing a series of circular apertures extending in a longitudinal direction of both said waveguides, said series of apertures being displaced a first distance from a center line of said wall of said first waveguide and being displaced a second distance from a center line of said wall of said second waveguide, said second waveguide propagating a plurality of higher order vertically polarized modes and said first waveguide propagating only a fundamental mode, and wherein said higher order modes of said second waveguide and said fundamental modes of said first waveguide are in phase synchronism and wherein said fundamental mode is coupled equally to each of said higher order modes.

7. The mode diversity coupler of claim 6 wherein said higher order modes are the $TE_{11L}$ and $TM_{11L}$ modes and said fundamental mode is the $TE_{01S}$ mode.

* * * * *